US006484446B2

(12) United States Patent
Young

(10) Patent No.: US 6,484,446 B2
(45) Date of Patent: Nov. 26, 2002

(54) DOOR SILL ASSEMBLY HAVING IMPROVED WEATHERSEAL

(76) Inventor: Robert H. Young, 521 S. Main St. P.O. Box 167, Beaver Dam, KY (US) 42320

( * ) Notice: Subject to any disclaimer, the term of this patent is extended or adjusted under 35 U.S.C. 154(b) by 73 days.

(21) Appl. No.: 09/805,723

(22) Filed: Mar. 15, 2001

(65) Prior Publication Data

US 2002/0129557 A1 Sep. 19, 2002

(51) Int. Cl.[7] ..... E06B 1/70
(52) U.S. Cl. ..... 49/469; 52/212
(58) Field of Search ..... 49/467, 468, 469, 49/471; 52/211, 212, 209

(56) References Cited

U.S. PATENT DOCUMENTS 3,967,412 A * 7/1976 Governale ..... 49/468
5,230,181 A 7/1983 Geoffrey et al.
4,831,779 A 5/1989 Kehrli et al.
5,136,814 A 8/1992 Headrick et al.
5,179,804 A 1/1993 Young
5,426,894 A 6/1995 Headrick
5,524,391 A * 6/1996 Joffe et al. ..... 49/468
5,542,217 A 8/1996 Larivee, Jr.
5,553,419 A 9/1996 Jenkins, II
5,887,387 A 3/1999 Dallaire
6,161,343 A 12/2000 Young
6,345,477 B1 * 2/2002 Kepler et al. ..... 52/204.1

* cited by examiner

*Primary Examiner*—Jerry Redman
(74) *Attorney, Agent, or Firm*—Maurice L. Miller, Jr.

(57) ABSTRACT

A door sill assembly for use in an external doorway of a building having a novel, flexible, resilient weatherseal strip is disclosed. The weatherseal strip is disposed between a threshold member and an opposing upright side wall of a metal weather cover. A portion of the strip is attached to and covers an exterior facing side portion of the threshold member and contains a flashing or flap depending downwardly from a sloping shoulder which laps over an upper edge portion of the upright side wall. Water falling upon the weatherseal as, for example, due to rainwater dripping from the external face of an overhanging door when in a closed position, will be directed over the sloping shoulder and flashing beyond the upright side wall onto a sloping foot plate of the weather cover, there to gravitate off an exterior end of the weather cover. The weatherseal thus protects underlying wood parts of the door sill assembly from moisture damage without being held in a compressed state.

6 Claims, 3 Drawing Sheets

DOOR SILL ASSEMBLY HAVING IMPROVED WEATHERSEAL

BACKGROUND OF THE INVENTION

This invention relates generally to a flexible, resilient weatherseal strip for an exterior doorway door sill assembly. More specifically, this invention relates to such a weatherseal which is connected to and covers an exterior facing side portion of a threshold member and which is adapted to cover a space between the threshold member and an upright end wall of an adjacent metal weather cover. The weatherseal features a flashing or flap which extends over the end wall such that water falling on the weatherseal spills across the end wall onto a sloping foot plate so as to gravitate off an end of the weather cover.

Broadly speaking, various flexible, resilient weatherseal strips of a type which are inserted between a threshold member and an adjacent metal weather cover have long been known and used in the prior art. See, for example, my U.S. Pat. No. 5,179,804 granted Jan. 19, 1993; U.S. Pat. No. 4,831,779 granted to D. W. Kehrli et al. on May 23, 1989; U.S. Pat. No. 5,136,814 granted to J. C. Headrick on Aug. 11, 1992; U.S. Pat. No. 5,230,181 granted to D. C. Geoffrey et al, on Jul. 27, 1993; U.S. Pat. No. 5,553,419 granted to T. E. Jenkins on Sep. 10, 1996; and U.S. Pat. No. 5,426,894 granted to J. C. Headrick on Jun. 27, 1995. These are compression type weatherseals which are compressed between either a door or an elongate threshold cap and an adjacent metal weather cover or foot plate.

A difficulty which can be encountered with these prior art weatherseals is their tendency to crack and, in some cases, form grooves or other separations from one of the members against which they are compressed over time under varying weather conditions. Such grooves, cracks, or separations then permit moisture to seep onto the wood members which underlie the weatherseal to cause rotting of the wood members over time necessitating replacement, most usually, of the entire door sill assembly.

By contrast, the flashing type of weatherseal strip of this invention contains a portion which covers any gap that might occur between a threshold member and an adjacent weather cover and directs water which might fall thereon over an adjacent, interior facing end wall of a metal weather cover onto a sloping foot plate to be carried off an end of the foot plate by gravity. All this is accomplished without placing the gap covering and the flashing portions of the weatherseal in compression between a threshold member and a weather cover.

Accordingly, by means of the present invention, the aforementioned difficulties encountered when using prior art weatherseals with exterior doorway door sill assemblies is substantially reduced, if not altogether eliminated.

SUMMARY OF THE INVENTION

It is an object of my invention to provide an improved weatherseal strip for an exterior doorway door sill assembly to protect underlying wood parts from moisture damage.

It is a further object of my invention to provide a flashing type of weatherseal strip for an exterior doorway door sill assembly which does not depend upon being compressed between two elements in order to protect underlying wood parts from moisture damage.

Briefly, in accordance with my invention, there is provided an exterior doorway door sill assembly comprising a base member and a threshold member mounted over and fastened to the base member. The assembly also includes a weather cover containing a foot plate mounted over an exterior facing side portion of the base member. The weather cover includes an upright side wall on an interior facing side thereof which is arranged in opposing relation to an exterior facing surface of the threshold member. The assembly further includes a flexible, resilient, form retentive weatherseal attached to the threshold member which covers an exterior facing portion of the threshold member. The weatherseal also covers a gap between the threshold member and the weather cover and an upper edge portion of the upright side wall. The weather cover is adapted to direct water falling thereon over the gap and upright side wall and onto the foot plate.

These and other objects, features and advantages of my invention will become apparent to those skilled in the art from the following detailed description and the attached drawings upon which, by way of example, only a preferred embodiment of my invention is illustrated.

DESCRIPTION OF THE PREFERRED EMBODIMENT

Figure 1:
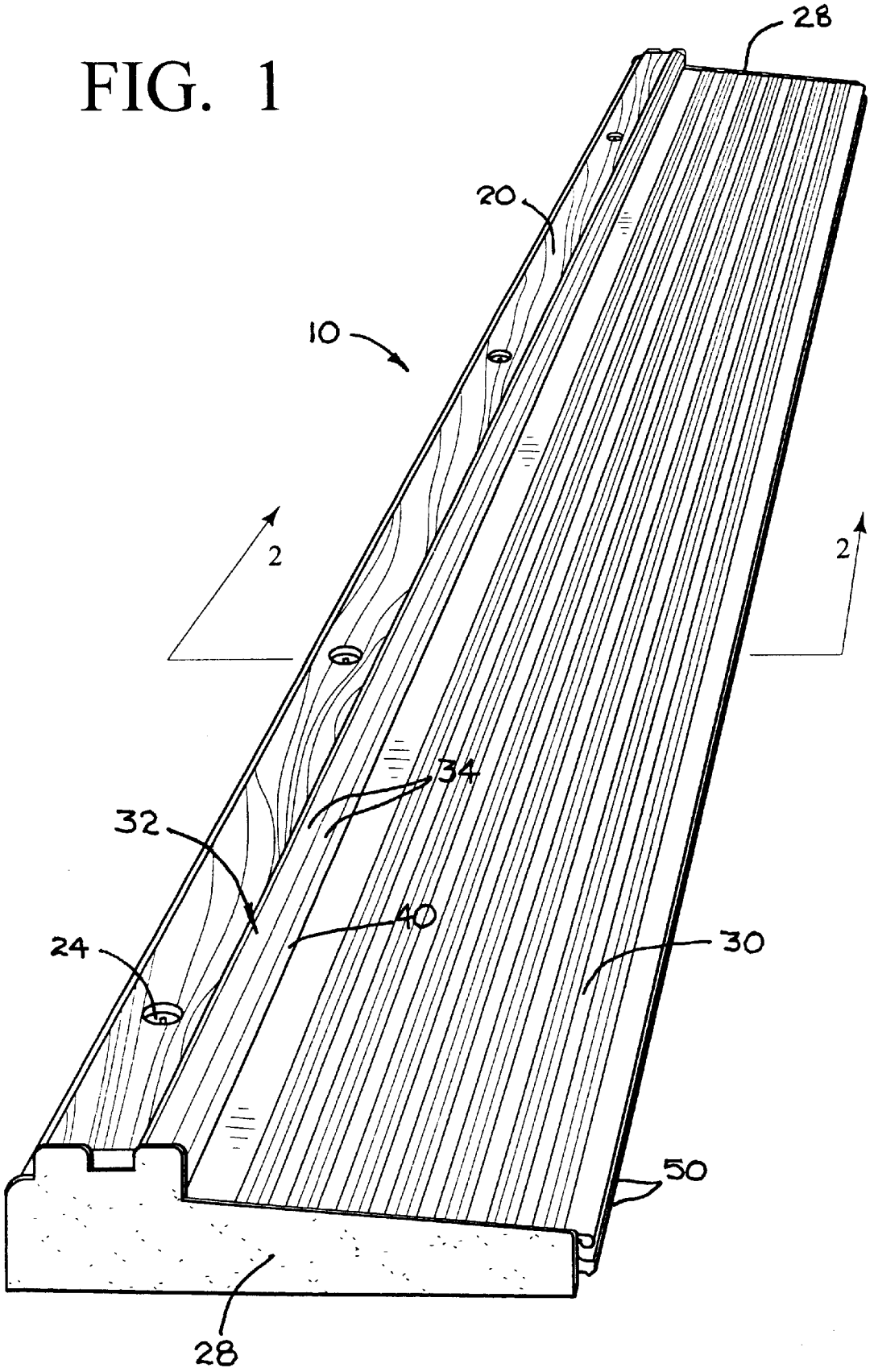
FIG. 1 shows a perspective view of a door sill assembly, thus illustrating a preferred embodiment of my invention.
Figure 2:
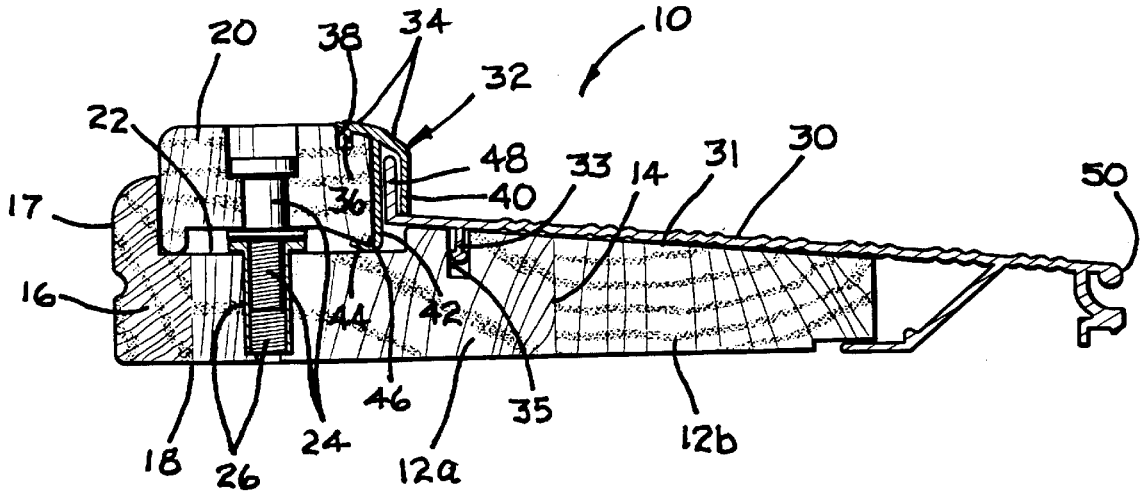
FIG. 2 shows a cross-sectional side elevation view of the assembly of FIG. 1 as viewed along cross-section lines 2—2 of the latter mentioned figure.
Figure 3:
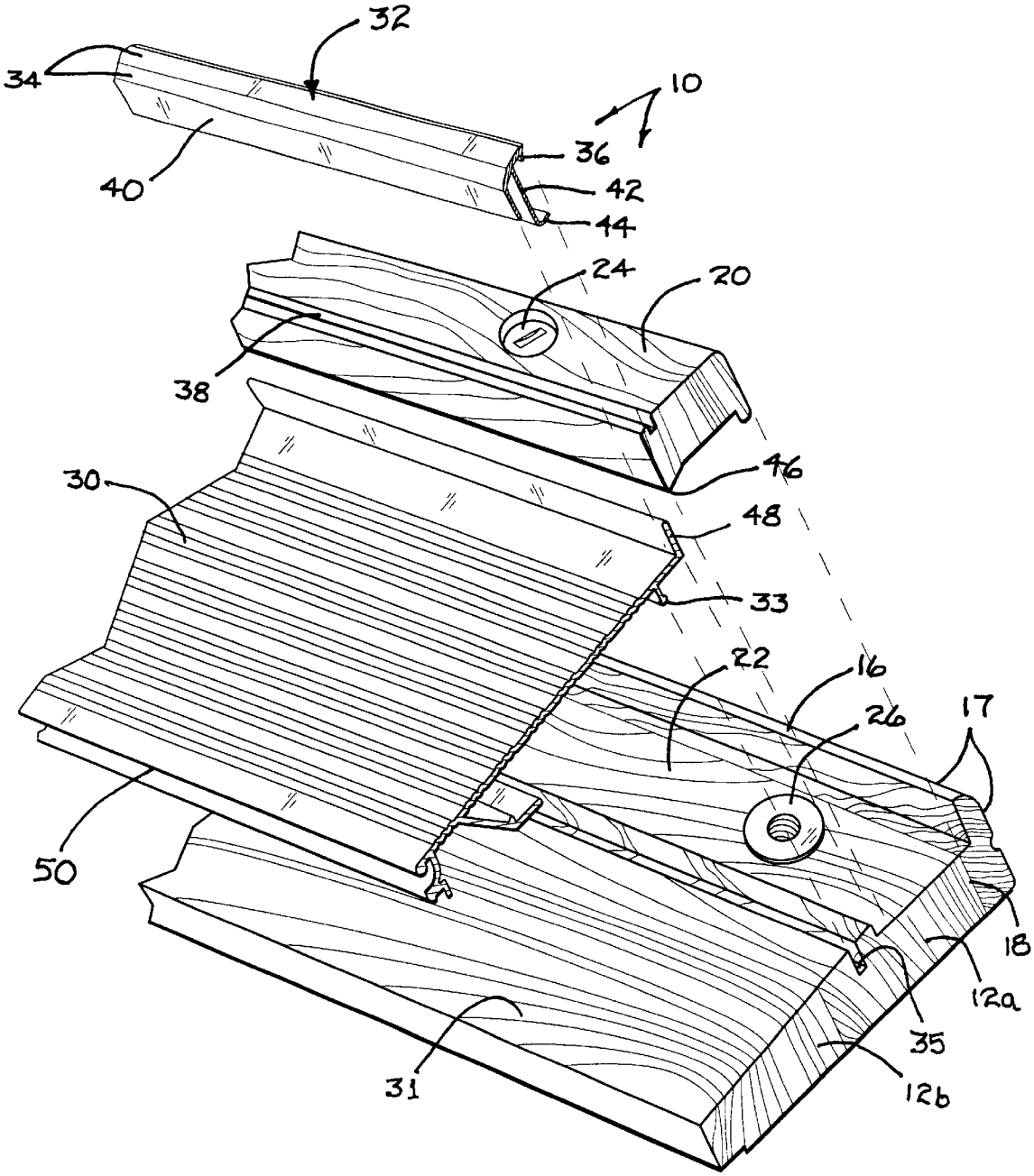
FIG. 3 shows an exploded perspective view of a fragment of the assembly of FIG. 1.

Referring now to the drawing figures, there is shown, in a preferred embodiment of my invention, an exterior door sill assembly, generally designated 10. The assembly 10 includes a wooden base member comprising two separate pieces 12*a* and 12*b* joined together with a suitable wood adhesive, glue or epoxy at an interface 14. Since the base member pieces are hidden from view by other elements of the assembly 10, the base member pieces 12*a* and 12*b* may, if desired, be constructed of a suitable non-stain grade wood such as, for example, poplar. The assembly 10 also includes an elongate wood trim member 16, known in the trade as a shoe strip, which shoe strip can be finely finished on interior facing, viewable surface 17 and joined to the base member piece 12*a* with a suitable wood adhesive as at interface 18. Such a shoe strip 16 may be constructed of oak or other suitable stain grade wood having an aesthetically pleasing appearance in a finished state, since it will be visible just to the interior of the doorway in which the assembly 10 is to be installed.

The assembly 10 further includes an elongated, adjustable threshold 20, which may also be constructed of a finely finished oak or other stain-grade wood operatively disposed on a recessed level floor 22 formed on and across adjoining portions of the base member piece 12*a* and shoe strip 16. The threshold 20 is adapted to extend between opposing door jambs, of conventional type, not shown, under an exterior door, also not shown, when the door is disposed in a closed position in the jamb. A series of conventional adjustable threaded fasteners 24 connect the threshold 20 to the base member piece 12*a* by disposition within corresponding interiorly threaded, conventional metal inserts 26. Opposite ends of the assembly 10 each contain a compressible, resilient, waterproof end seal gasket 28 (FIG. 1 only) which is shaped to conform to and cover an end grain of the base member pieces 12*a* and 12*b*, the shoe strip 16 and the threshold 20. The gaskets 28 can be stapled or glued to the base member pieces 12*a* and 12*b* and compressed between the assembly 10 and opposing door jambs when the assembly is operatively installed in an exterior doorway in a usual and well known manner.

The assembly 10 additionally includes a metal weather cover 30 which rests upon a sloping upper surface portion 31 of the base member pieces 12*a* and 12*b* next to the floor 22. The weather cover 30 can be constructed of a suitable lightweight, durable, rustproof metal such as an aluminum alloy. An elongate tab 33 depending from a lower surface of the weather cover 30 fits within a transversely extending groove 35 formed in an upper surface portion of the base piece 12*a*. Lastly, the assembly 10 includes a flashing type weatherstrip, generally designated 32, which can be formed of a flexible, resilient, form retentive material such as vinyl plastic. The weatherstrip 32 includes a longitudinally extending sloping shoulder 34, an upper side portion of which contains a longitudinally extending, downwardly projecting tab 36 which inserts into an upwardly opening groove 38 formed in an upper exterior side portion of the threshold 20. A lower end portion of the shoulder 34 is integrally connected to a vertically downwardly extending flap, flashing or wall portion 40. A longitudinally extending leg portion 42 depends downwardly from the shoulder 34, intermediate the tab 36 and the flap 40, and contains a hooked lower end portion 44 which wraps around a rounded lower exterior corner portion 46 of the threshold 20. The weatherstrip 32 is thus secured to an exterior facing side portion of the threshold 20 by tab 36 and the hooked lower end portion 44. The leg portion 42 thus covers an exterior facing surface portion of the threshold 20 and lies between that surface and an opposing surface of an upright side wall 48 of the weather cover 30. The flap 40 depends from a lower end of the shoulder 34 so as to overhang and cover an upper edge and an exterior facing vertical surface of the upright side wall 48. The sloping shoulder 34, in cooperation with the flap 40, thus forms a flashing which completely covers any gap that might otherwise exist or occur over time between an interior facing vertical surface of the side wall 48 and the leg portion 42. Accordingly, rainwater or other moisture that falls upon the shoulder 34 of the weatherstrip 32, or that drips thereon from an exterior face of an overhanging door when in a closed position, will spill over the sloping shoulder and over the upright side wall 48 along the flap 40 onto the sloping upper surface of the weather cover 30 so as to gravitate harmlessly off an exterior side 50 of the assembly 10. The weatherstrip 32 thus prevents damaging moisture from finding its way onto the wood floor 22 along a gap that might otherwise occur between an exterior facing surface of the threshold 20 and an adjacent end of the weather cover 30, a problem that has long existed in the prior art with use of conventional weatherstrips.

Although the present invention has been described with respect to specific details of a certain preferred embodiment thereof, it is not intended that such details limit the scope of this patent other than as specifically set forth in the following claims, taking into account reasonable equivalents thereof.

I claim:

1. An exterior doorway door sill assembly comprising a base member;

a threshold member mounted over and fastened to said base member;

a weathercover including a foot plate mounted on an exterior facing end portion of said base member and having an upright side wall on an interior facing side thereof arranged in opposing relation to an exterior facing surface of said threshold member; and a flexible, resilient, form retentive weatherseal having a shoulder which slopes downwardly from an upper interior facing side to a lower exterior facing side, said upper side being attached in a groove on an upper surface of said threshold member such that said shoulder extends over an upper exterior facing corner portion of said threshold member, thence downwardly over and across a gap between said threshold member and said upright side wall and further downwardly across an upper edge of said upright side wall, whereby water falling on an upper interior facing edge portion of said shoulder over said threshold member will gravitate downwardly along said shoulder across said gap and said upright side wall onto said foot plate.

2. The door sill assembly of claim 1 wherein said base member defines a sloping upper surface formed on an exterior facing upper end portion thereof which slopes downwardly in an exterior facing direction, said foot plate being mounted on said sloping upper surface, said base member further defining a level floor located on an interior facing upper end portion thereof next to said sloping surface, said threshold member being mounted on said floor.

3. The door sill assembly of claim 1 further comprising a shoe strip trim element fastened to an interior facing side portion of said base member, said trim element and an interior facing portion of said base member defining a recessed level floor thereacross, said threshold member being disposed over said floor.

4. The door sill assembly of claim 1 wherein said threshold member is adjustably and removably fastened to said base member.

5. The door sill assembly of claim 1 wherein said weatherseal comprises a longitudinally extending tab depending downwardly from an upper end of said shoulder, an upper surface portion of an upper exterior facing corner portion of said threshold member containing a longitudinally extending upwardly opening groove into which said tab projects;

a longitudinally extending leg member depending downwardly from said shoulder intermediate said tab and an end of said shoulder, said leg member covering an exterior facing portion of said threshold member and containing a hooked lower end portion which wraps around a lower exterior corner of threshold member; and a flap depending downwardly from the end of said shoulder over an upper edge portion of said upright end wall.

6. A door sill assembly adapted for disposition in a lower end portion of an exterior doorway to a building comprising:

a base member defining a sloping upper surface on an exterior side portion thereof, said upper surface sloping downwardly in an exterior facing direction;

a shoe strip trim element attached to an interior side of said base member, said base member and said trim element defining a level floor extending between opposing door jambs of an external doorway of a building when said assembly is disposed in an operative position;

a threshold member disposed over said floor adjustably attached to said base member;

a weather cover having a foot plate which rests upon said sloping upper surface and including an upright side wall which extends over an exterior facing side portion of said floor in opposing relation to an exterior facing side of said threshold member; and a flexible, resilient, form retentive weatherseal connected to said threshold member and including a leg portion which covers an exterior facing surface of said threshold member, a sloping shoulder and a flap which extend over a gap between said upright side wall and over an upper edge of said upright side wall such that water falling upon said sloping shoulder will spill over said shoulder and said flap, beyond said upright side wall portion onto said foot plate and will gravitate off an exterior side of said weathercover.

* * * * *